United States Patent [19]

Larner

[11] 4,397,614

[45] Aug. 9, 1983

[54] UNBALANCED SPOOL

[75] Inventor: Donald A. Larner, Kingston upon Thames, England

[73] Assignee: Fluid Devices Limited, Great Britain

[21] Appl. No.: 332,472

[22] Filed: Dec. 21, 1981

Related U.S. Application Data

[63] Continuation of Ser. No. 954,291, Oct. 24, 1978, abandoned.

[51] Int. Cl.[3] ..... F04B 35/00; F01L 25/04

[52] U.S. Cl. ..... 417/403; 91/301; 137/625.66

[58] Field of Search ..... 417/401, 403, 404; 91/290, 301; 137/106, 625.66

[56] References Cited

U.S. PATENT DOCUMENTS

| | | | |
|---|---|---|---|
| 1,495,333 | 5/1924 | Kruger | 91/301 X |
| 3,901,313 | 8/1975 | Donigvian et al. | 417/403 X |
| 4,028,014 | 6/1977 | Cocks | 417/403 |
| 4,068,983 | 1/1978 | Balme et al. | 417/401 |

FOREIGN PATENT DOCUMENTS

| | | | |
|---|---|---|---|
| 1207515 | 2/1960 | France | 417/403 |
| 5549 | of 1912 | United Kingdom | 91/301 |
| 960366 | 6/1964 | United Kingdom | 91/301 |
| 1014909 | 12/1965 | United Kingdom | 137/625.66 |

*Primary Examiner*—Leonard E. Smith

[57] ABSTRACT

This invention concerns a fluid operated valve with a slidable valve member having formations enabling differential operating forces to be applied thereto and preferably having means to relieve pressure from the leading formation during travel of the member to promote 'snap' action and preferably being associated with a pneumatic piston and cylinder motor driving an hydraulic pump in an integrated unit constituting a pneumatic/hydraulic convertor.

9 Claims, 5 Drawing Figures

UNBALANCED SPOOL

This is a continuation of application Ser. No. 954,291, filed Oct. 24, 1978, now abandoned.

BACKGROUND OF THE INVENTION

This invention relates to a fluid operable mechanism and is particularly concerned with a pneumatic/hydraulic convertor in which a supply of a gaseous medium under pressure is used to generate pressure in and control the application of a liquid medium.

It has for many years been common practice in very many industrial applications to use fluid power operated motors to move machine parts particularly where similar repeated operations are necessary. Broadly such motors have been pneumatic or hydraulic.

Most factories are equipped with the necessary machinery to provide throughout the premises a continuous supply of compressed air which can easily be piped to individual machines. Pneumatic motors are comparatively simple, trouble free and inexpensive to install and use an are entirely satisfactory in many circumstances. However they do suffer from a number of well-known disadvantages which preclude their use for many applications. The most important disadvantages are firstly that because air is elastic it is difficult to achieve precise control and in view of the low pressures involved large displacement volumes are required so that actuators become bulky. Hydraulic motors on the other hand offer very precise control at the point of use and can operate at very high pressure so that large forces can be exerted with the displacement of small quantities of liquid. However the pumping equipment on associated apparatus for hydraulic motor installations is bulky, complex and costly and the fact that the operating medium is substantially incompressible introduces difficulties which add to the costs of the installation.

Many proposals have been made for combining pneumatic and hydraulic systems to take advantage of those features of each system which are best suited to perform particular functions. It is thus known to provide a hydraulic actuator at the point of use and to power this pneumatically.

SUMMARY OF THE INVENTION

It is accordingly an object of the present invention to provide an improved pneumatic/hydraulic convertor which is of particularly simple construction; is inexpensive to produce and yet is particularly reliable in operation.

A further object is to provide such a convertor in a single unit of interchangeable modular parts.

Yet other objects of the invention concern the provision of an improved four way floating spool air valve; an improved liquid pumping unit and an improved air drive piston which may be controlled by the air valve and which can be coupled directly with the pumping unit all of which may be incorporated in the pneumatic/hydraulic convertor.

According to one aspect of the present invention there is provided a pneumatic/hydraulic convertor in which a liquid pump unit to extend within a liquid reservoir; a piston and cylinder air motor unit to be coupled with the liquid pump unit and an air control valve unit for the air motor unit are respectively secured one above the other as replaceable modules in a stack, each of the units being cylindrical and of similar maximum size and shape transverse to its longitudinal axis.

According to another aspect of the present invention there is provided a fluid operated valve comprising a member slidable in a bore under the action of fluid pressure between positions in which it selectively connects an inlet port for the fluid with a pair of outlet ports, a longitudinal counterbore at each end of the member and a bias piston slidable in each counterbore to act between a base of that counterbore and the associated end of the bore, means for selectively applying fluid pressure simultaneously to one end of the bore and to the interior of the counterbore remote from said one end or simultaneously to the other end of the bore and to the interior of the counterbore remote from said other end so that when the member is located at either end of the bore a differential force is applied thereto to move it away from said end.

According to a further aspect of the present invention there is provided a fluid operated valve comprising a member slidable in a bore under the action of fluid pressure between positions in which it selectively connects an inlet port for the fluid with a pair of outlet ports; a pair of symmetrically disposed fluid pressure responsive formations on the member, means for selectively applying fluid pressure simultaneously to either end of the bore and to that formation remote therefrom so that when the member is located at either end of the bore a differential force is applied thereto to move it away from that end and including means for relieving pressure from the leading formation during movement of the member so that the remainder of the movement of the member in the same direction is rapidly accelerated and fully completed.

The valve of either of the two preceding paragraphs is preferably associated with a piston reciprocable in a cylinder under the action of a fluid, a pair of signal ports opening into the interior of the cylinder and respectively connected with the ends of the bore of the valve, movement of the piston selectively connecting the signal ports with the fluid driving the piston so as to produce repeated reciprocation of the piston. The piston may be driven by the same fluid as the valve selectively supplied to opposite ends of the cylinder under the control of the valve. Movement of the piston may be used to drive an associated hydraulic pump so that the valve, the piston and cylinder and the pump constitute a pneumatic/hydraulic converter.

BRIEF DESCRIPTION OF DRAWINGS

All the above represent different aspects of the same invention and these and other features thereof will now be described by way of example with reference to the accompanying drawings in which.

DESCRIPTION OF THE PREFERRED EMBODIMENTS

Figure 3:
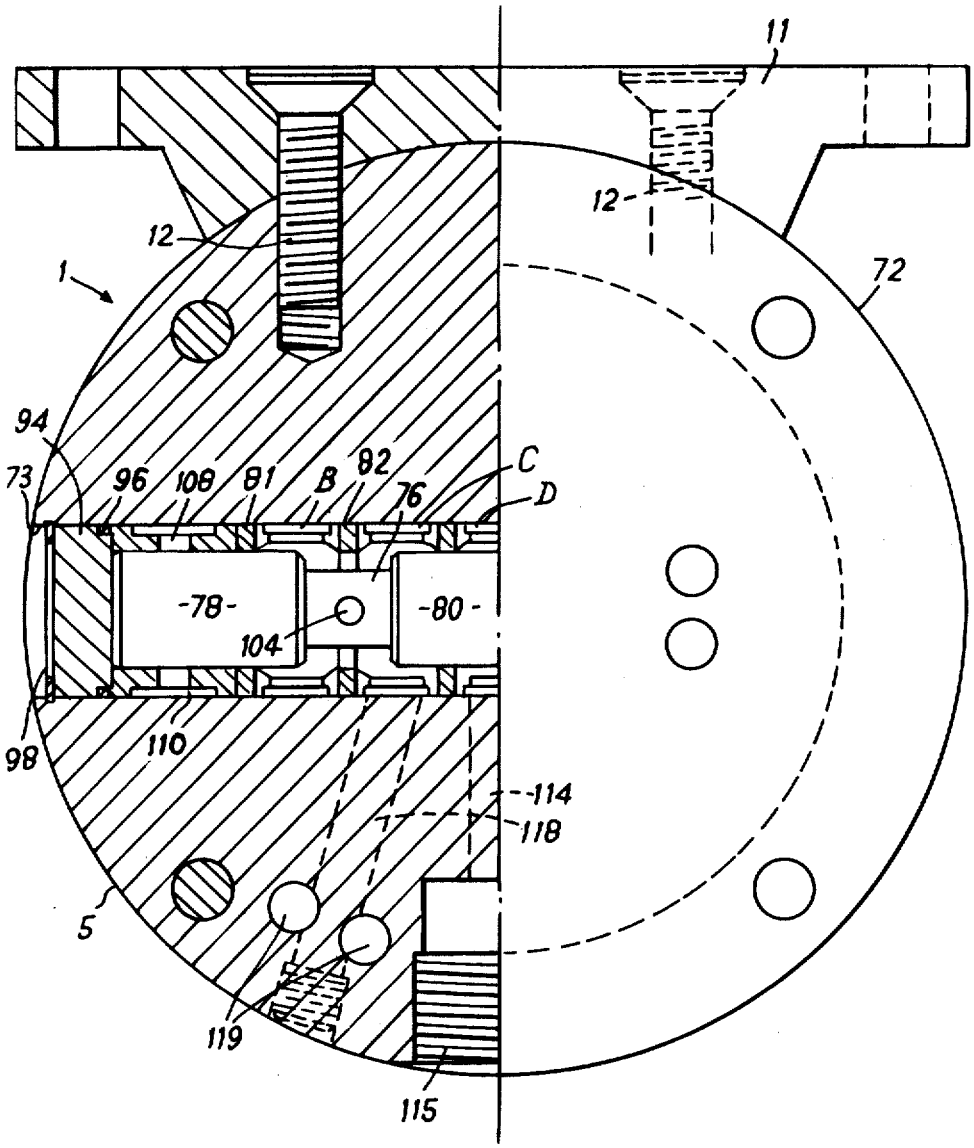
FIG. 3 is a section on the line III—III of FIG. 1.

Referring to FIGS. I to 4 of the drawings a pneumatic/hydraulic convertor I comprises a reservoir unit 2; a liquid pump unit 3; a piston and cylinder air motor unit 4; an air control valve unit 5 and a silencer unit 6. These units are circular in transverse cross section and are respectively secured one above the other to form a stack by means not shown with the interposition of gaskets 7, 8 and 9; no gasket being located between the units 5 and 6 which are spearated by an annular slot 10 as will be described later. As shown in FIG. 3 mounting brackets such as II are secured to the stack by screws such as 12 so that the convertor may be mounted on a suitable vertical surface adjacent its point of use.

The liquid pump unit 3 has an adaptor ring 13 around its lower surface and this is formed with a number of circumferential apertures to receive inwardly directed pegs 14 carried at the upper end of the reservoir 2 the latter being engaged from below the pump unit 3 and then being locked with a bayonet action. A central tubular extension 15 projects downwardly from the pump unit 3 into the reservoir 2.

The pump unit 3 has a central bore 16 widening at 17 within the extension 15 and further widening at 18 towards the lower end of the extension which is internally threaded at 19 to receive a tubular valve body 20 the lower end of which is provided with a suction screen 21 and the upper end of which is formed with a conical seating 22. An inlet valve member 23 with its lower surface 24 ground to mate with the seating 22 is carried on a cruciform vane assembly 25 slidable within the bore 26 of the valve body 20. The inlet valve member is urged toward its closed position by a spring 27 acting between the valve body and the vane assembly.

The pump unit 3 is formed with a radial liquid inlet port 28 communicating with a tube 29 extending downwardly into the reservoir 2 and an oppositely disposed radial liquid outlet port 30 communicating through a passage 31 with the upper end of the widened part 17 of the bore 16. The unit 3 also has a breather port 32 communicating through a passage 33 with a central region of the bore 16; through an opening 34 with the reservoir 2 and through a filter disc 35 with atmosphere.

The piston and cylinder air motor unit 4 has a cylinder 36 and a piston assembly indicated generally at 37. The cylinder 36 is exhausted to atmosphere through a group of apertures 38 disposed centrally of its length and opening into a port 39 provided with a filter disc 40. In addition the cylinder has a signal port 41 located above the apertures 38 and communicating through a passage 42 with the upper face 43 of the unit 4 at 44. The unit 4 has an oppositely disposed signal port 45 located below the apertures 38 and communicating through a passage 46 with the upper face 43 of the unit at 47.

Figure 1:
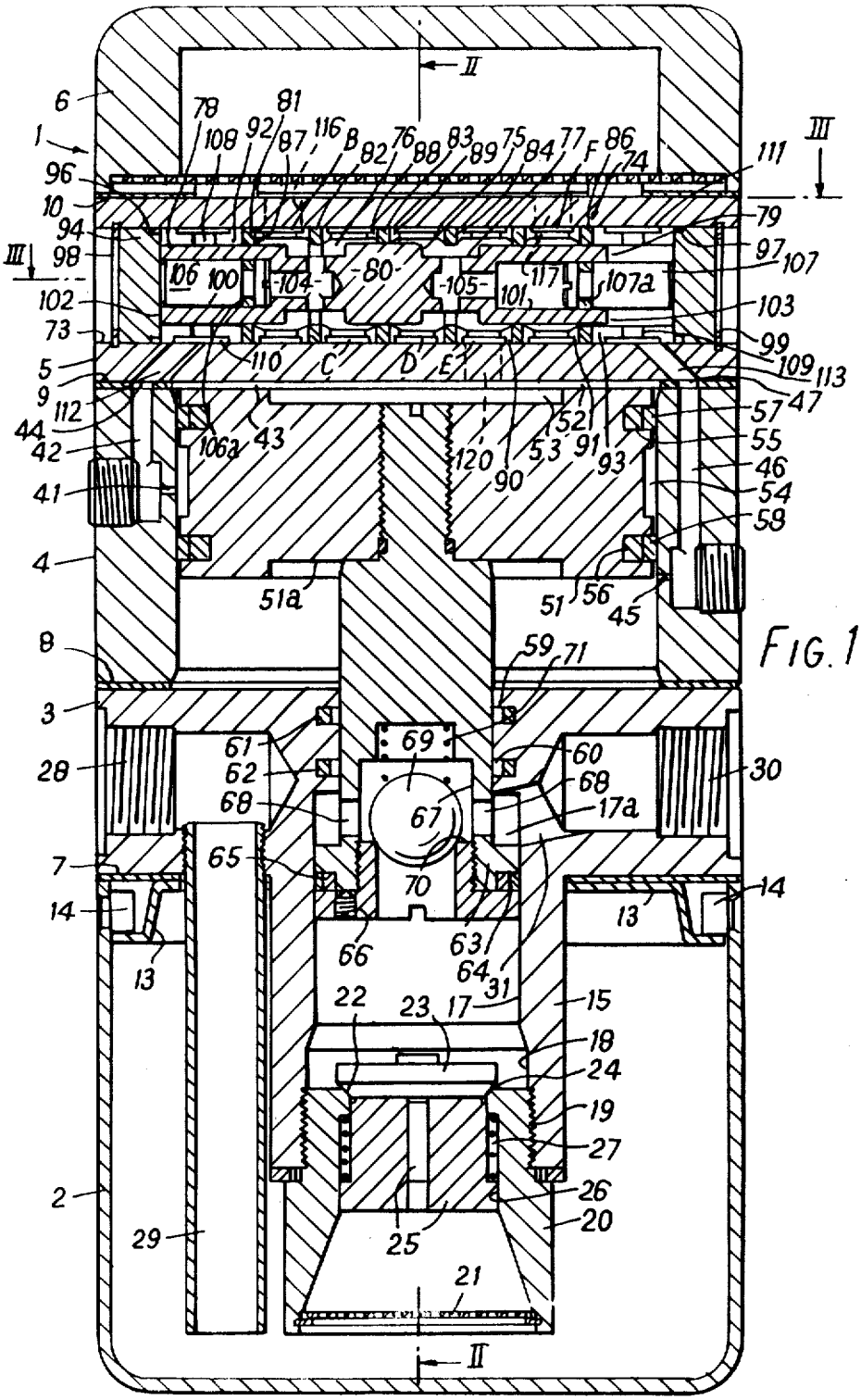
FIG. 1 is a vertical section through a pneumatic/hydraulic convertor according to the present invention.

The piston assembly 37 comprises a shaft 48 carrying a piston 49 at its upper end and extending downwardly into the bore 16 and 17 at its lower end 50 which incorporates a liquid transfer valve mechanism as will be explained hereafter. The piston has a lower face 51 formed with a central recess 51*a*, an upper face 52 which is formed with a central recess 53 and the peripheral surface of the piston has a central groove 54 further grooves 55 and 56 above and below the groove 54 carrying piston rings 57 and 58 of the 'slipper' type the outer parts of which are of reinforced polytetrafluoethylene to ensure low friction in use. The axial spacing between the rings 57 and 58 is such that when the piston is in its uppermost position (as shown in FIG. 1) the signal port 45 is uncovered by the piston and when the piston is in its lowermost position (not shown) the signal port 41 is uncovered by the piston. In all positions of the piston 49 the groove 54 communicates with the exhaust apertures 38. A further passage (not shown) extends downwardly through the wall of the cylinder 36 and opens at a position marked 'A' (FIG. 2) which is always below the piston 49.

The lower end 50 of the piston shaft 48 slides within the bore 16 and is sealed thereagainst by rings 59 and 60 disposed in grooves 61 and 62 located one above and the other below the passage 33. The lower part 63 of the end 50 is of increased diameter to slide in the widened part 17 of the bore 16 and is sealed thereagainst by a ring 64 carried in a recess 65 between the part 63 and a bush 66 threaded into an aperture 67 formed in the lower end 50 of the shaft 48. The upper part of the bore 17 constitutes a chamber 17*a* to be acted on by the part 63 to constitute part of a liquid pump. The aperture 67 has radial apertures 68 permanently communicating with the upper end of the widened part 17 of the bore 16 and through the passage 31 with the liquid outlet port 30. A ball 69 is seated on the inner end 70 of the bush 66 and is urged into a closed position against the bush by a spring 71. It will be understood here that other forms of valve closure may be used.

The air control valve unit 5 comprises a cylindrical block 72 formed with a diametrical bore 73 to constitute a housing for a four way spool valve mechanism indicated generally at 74. This mechanism comprises a spool 75 which may be of reinforced polytetrafluoethylene and has two reduced diameter recesses 76 and 77 separating end regions 78 and 79 from a central part 80. The spool floats in six elastomeric sealing rings 81, 82, 83, 84, 85 and 86 respectively separated by annular spacers 87, 88, 89, 90 and 91 and held between end rings 92 and 93. The whole assembly is held within the borè 73 by shock resisting plastic end plugs 94 and 95 incorporating end seals 96 and 97 and respectively held in place by circlips 98 and 99.

The spool 75 is formed with axial bores 100 and 101 from its end faces 102 and 103 and passages 104 and 105 respectively communicate between these bores and the peripheral surfaces of the reduced diameter parts 76 and 77. Freely floating bias pistons 106 and 107 having sealing rings 106*a* and 107*a* are slidable in the bores 100 and 101.

Each of the spacers 87–91 is formed with radial apertures and external recesses so that, in well-known manner, a series of annular ports B, C, D, E and F are provided. The end rings 92 and 93 are also formed with radial apertures such as 108 and 109 and external recesses 110 and 111 respectively communicating with passages 112 and 113 the lower ends of which respectively register at 44 and 47 of the passages 42 and 46 in the cylinder 36. It will here be understood that the end regions 78 and 79 of the spool 75 extend with clearance in the rings 92 and 93 to permit air under pressure to flow freely therebetween.

The annular port D is connected through passages 114 (FIG. 2) with an air entry port 115. The ports B and F are exhaust ports and are connected directly through short passages 116 and 117 with the interior of the silencer unit 6. The port C as shown in FIG. 3 communicates with passages 118 and 119 the latter extending downwardly through the unit 5 and registering with the further passage (not shown) referred to above in the cylinder wall 36 which terminates in an outlet at the position 'A' in the lowest part of the cylinder 36. The port E communicates directly through a passage 120 with the upper part of the cylinder 36.

The silencer unit 6 incorporates a perforated screen 121 supported on pillars such as 122 and carrying the silencer body 123. The space 124 within the silencer is filled with an accoustically absorbent material such as glass wool (not shown) and as mentioned above the periphery of the unit 6 is spaced from the air control valve unit 5 by the slot 10.

The reservoir unit 2 is provided with a sight glass arrangement indicated generally at 125 and since the gasket 7 seals the reservoir to the pump unit 3 all air exchange with the surrounding atmosphere (due to varying liquid level in the reservoir) occurs through the filter 35.

It will however be understood that the silencer unit 6 and the reservoir 2 need not be integral parts of the apparatus but could form parts of associated apparatus.

In operation the double acting air driven piston 49 is coupled directly with the liquid transfer valve mechanism constituting a double acting hydraulic pump at the lower end of the piston shaft 48. The piston 49 reciprocates automatically under control of the air control valve unit 5 operation of which is itself controlled by reversing signals derived from the piston and cylinder air motor unit 4.

This broadly stated operation will now be described in detail starting from the condition in which all the parts are in the positions shown in FIGS. 1, 2 and 3 of the drawings. It will be assumed that a suitable compressed air supply is connected to the air entry port 115; that the liquid outlet port 30 is connected to a suitable piston and cylinder motor unit (not shown) for example operating a movable part of a metal working machine in a factory; that the liquid inlet port 28 is connected with a liquid exhaust of the piston and cylinder motor unit and that a proper quantity of hydraulic liquid such as mineral oil or a water/soluble oil mixture is contained in the reservoir 2 and the sealed circuit coupling the liquid pump unit 3 with the piston and cylinder motor unit.

Figure 2:
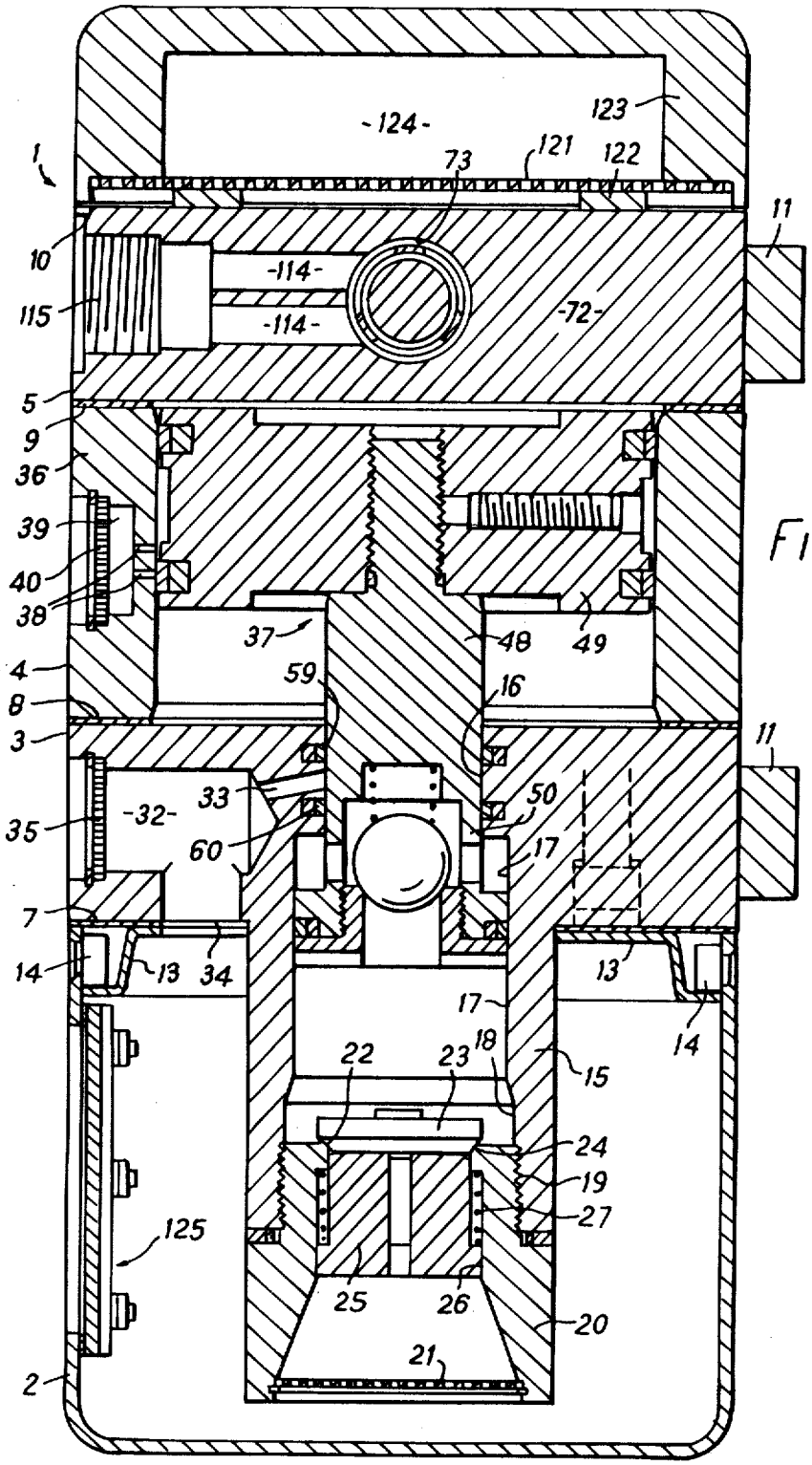
FIG. 2 is a section on the line II—II of FIG. 1.

In the condition shown in FIGS. 1, 2 and 3 the piston 49 is in its uppermost position (having just completed its upward stroke); the inlet valve member 23 is closed (having been opened by induction to draw liquid from the reservoir into the bore 17); the ball valve 69 is closed (liquid having just been pumped from the chamber 17*a* through the outlet port 30) and the spool 75 is in its extreme left-hand position as viewed in FIGS. 1 and 2 with the bias piston 107 in its extreme right-hand position. Thus compressed air from the port D passes via the part 77, the port E and the passage 120 into the recess 53 in the upper surface of the piston 49 and at the same time this air also passes through the passage 105 into the bore 101 to act on the piston 107 to hold the latter in its extreme right-hand position and to react in the reverse direction on the spool 75 to hold the latter in its extreme left-hand position. At the same time all other parts of the spool valve, the space beneath the piston 49 and the groove 54 are all exhausted to atmosphere, as follows:

Ports B and C are interconnected via the part 76 and are connected via passage 116 to the silencer and the counterbore 100 is also connected via passage 104 to the silencer and port F is connected via passage 117 to the silencer. The recess 110 is exhausted via the passages 112, 42 of the signal port 41, the groove 54, the apertures 38 (FIG. 2) and the port 39. The recess 111 (and the annular space around the exposed end of the piston 107) is exhausted through the passages 113 and 46, the signal port 45, the space below the piston 49 and the passages 119 and 118 (FIG. 3) to the port C.

Thus the piston 49 is caused to move downwardly and as it does so the ball valve 69, 70 opens and liquid in the lower part of the bore 17 is displaced through the valve to be above the increased diameter part 63 of the piston shaft 48 and as the latter moves downwardly its volume entering the bore 17 pumps this liquid through the outlet port 30 since this movement also holds the inlet valve member 23 closed. As the piston 49 descends, the signal port 45 is passed by the ring 58 but this causes no change in the general operating conditions since the port 45 then communicates with atmosphere via the groove 54. However, when the ring 57 passes the signal port 41 compressed air from the above piston 49 passes through the passages 42 and 112 and the recess 110 to be applied to the left-hand end face 102 of the spool 75 and the end face of the piston 106. At this time no other change has occurred in the system and since the combined areas of the end face 102 and the end of the piston 106 are greater than the cross-sectional area of the counter bore 101 to which air pressure is still being applied a differential force is applied to the spool and the latter starts to move to the right as viewed in FIGS. 1 and 2 (while the piston 49 still continues to move downwards).

Figure 4:
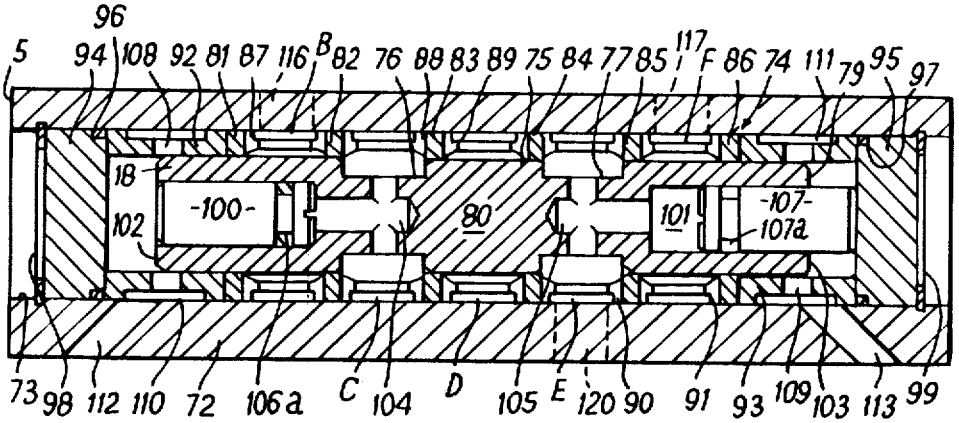
FIG. 4 is a vertical section of only the air control valve of FIG. I with the spool in a different position.

When the spool 75 has reached its mid position as shown in FIG. 4 the annular ports B, C, D, E and F are sealed from one another so that pressure is applied to the spool across the left-hand end face 102 and the end of the piston 106 and to the counterbore 101 while the other end of the spool remains exhausted to atmosphere.

Further slight movement of the spool to the right then reverses the valve in that compressed air from the port D passes via part 76 to port C and thence via the passages 118 and 119 to the lower end of the cylinder 36. Compressed air also passes via the passage 104 to the iner end of the counterbore 100. The port E is at this time exhausted via the part 77 and port F. Thus the counterbore 101 is also exhausted through the passage 105. The bias pistons 106 and 107 thereby co-act to complete movement of the spool to the right.

The spool 75 thus "snaps" across to its extreme right-hand position as viewed in FIGS. 1 and 2. During this stage of movement of the spool the piston 49 closely approaches its lowermost position.

When the spool 75 has moved to the right and the port D communicates with the port C then air under pressure is applied to the cylinder beneath the piston 48 and the latter reaches its lowermost position and then commences to rise. Air under pressure which has passed through the passage 104 to actuate the bias portion 106 in the opposite direction serves to hold the spool in its new end position. In this position the port E communicates with the exhaust port F so that air above the piston 49 and in the spool valve is exhausted through the port F. During this upward movement of the piston 49 liquid in the chamber 17*a* is driven out of the port 30 and the inlet valve 23 is opened so that a quantity of liquid sufficient to provide for a double stroke of the liquid pump flows from the reservoir into the bore 17.

The reverse of the action described above now takes place in that when the ring 58 passes the signal port 45 air under pressure is applied to the right-hand end 103 of the spool to effect return of the latter to its extreme left-hand position as the piston approaches its uppermost position.

It will be understood that the changeover of the spool 75 and reversal of movement of the piston 49 both occur very rapidly and that the disposition of the signal ports 41 and 45 are such relative to the value of the controlling air pressure and the masses of the moving parts so that just as the spool 75 reaches its mid position (in either direction of travel) the piston 49 is closely approaching one or other of its end positions.

The "snap" action arrangement of the spool 75 is particularly reliable no matter how slowly the signal ports 41 and 45 are uncovered or how low the pressure applied to the system. If the applied system pressure should be too low to work either the spool 75 or the air piston 49, the mechanism simply stalls until adequate pressure is restored.

It will be understood that although the air control valve unit 5 has been described as a spool valve it may be substituted by a piston valve or a slide valve similarly connected with the air motor 4. Whichever form of valve is employed it will also be understood that the differential force on the valve member and the 'snap' action referred to above can be achieved by alternative constructions. For example instead of the bias pistons in their counterbores the valve member could be provided with a pair of symmetrically disposed additional formations comprising piston faces conveniently disposed one at each end and having such areas exposed in the bore or an extension thereof that the differential pressure referred to above would be created. Pressure applied to the formations could be relieved also as described above to achieve the 'snap' action.

The air drive piston is preferably made of light-weight, shock resisting material such as reinforced plastic (e.g.) to safely absorb shock if it should reach the extremities of its travel under certain conditions. The piston rod is preferably made of a light-weight, wear and corrosion resisting material such as hard coated aluminium alloy to provide good wear characteristics for sliding through the rings 59 and 60.

The pump piston is positively sealed by a dynamic seal 64 and the piston rod 48 passes through two positive seals 59 and 60 the latter sealing the hydraulic fluid within the upper chamber 17 while the former seals compressed air within the lower part of the cylinder 36. The passage 33 drains the annulus between the seals to the port 32; any air leakage through seal 59 escapes to atmosphere through filter disc 35 and any fluid leakage through seal 60 is returned by gravity through the passage 34 to the reservoir 2. Thus, any potential cross leakage between air and fluid systems is positively prevented.

It will be understood that the spring 27 ensures rapid and complete closure of the inlet valve 23 at the commencement of the down stroke of the piston 49.

The tube 29 in the reservoir 2 ensures that liquid returned to the reservoir through the inlet port 28 enters below the level of liquid in the reservoir so as to avoid air entrapment and consequent foaming.

The signal ports 41 and 45 are preferably made up of closely spaced clusters of small holes to enable a powerful biassing signal to be applied to the spool valve whilst avoiding the necessity of passing the rings 57 and 58 over large holes at high air pressures which would shorten their useful life.

When the spool 75 moves to exhaust either the top or bottom of the cylinder 36 this takes place very suddenly because the spool valve has a large flow capacity, and this very sudden disposal of the exhaust air is necessary if the commencement of full power on the return stroke of the air drive piston is not to be delayed.

Without silencing, considerable sound would be generated at the instant of exhaust, sounding somewhat like the 'crack' of a firearm when discharged. The perforated screen 121 and the enclosed glass wool (not shown) act as an acoustic 'cushion' to absorb the initial and very rapid exhaust of air together with the very sharp sound it generates, thus lowering the air pressure prior to atmospheric exhaust via the annular slit 10 formed around the periphery of the silencer casing.

The pressure generated at the liquid outlet port 30 is nominally equal to the applied air pressure multiplied by the ratio of areas of the air piston 49 and the piston rod 48. In the particular arrangement illustrated, this ratio is 10:1, so the application of ordinary shop air to the device will result in a hydraulic output of some 600 to 1200 lbs./Sq.in. (say 40 to 80 bars) according to the pressure available.

When the piston 49 reverses, the upward pull on the piston rod thus generated is balanced by the fluid contained in the bore 17 acting on the annular area between the piston rod and the part 63. By suitable dimensioning, this output pressure can be arranged to correspond to that generated during the down stroke, although one must bear in mind that the upward force generated on the air drive piston 49 is somewhat reduced by the presence of the piston rod 48 and make suitable allowance when deciding the exact size of the part 63.

During this upward stroke, the transfer valve 69, 70 is held shut and fresh fluid is inducted through the inlet valve 23 sufficient to provide for one complete double stroke of the pump mechanism.

By varying the sizes of the piston rod 48, the piston 49 and the part 63 any desired pumping ratio can be achieved and this particular design is arranged to accommodate ratios between 5:1 and 40:1, to meet most system requirements.

The intention of the present invention is to generate a relatively large volume of liquid at pressures such as are normally employed in low-power industrial hydraulic systems. These rarely exceed 3,000 lbs./Sq.in. (200 bar) and the majority are below 1,000 lbs./sq.in. (70 bar).

The particular version described above, having a total axial length of about 13 inches and a diameter of about 6 inches is intended to operate at cyclic frequencies up to 8 c.p.s (480 c.p.m.) at which level the hydraulic output will yield approximately 2 horsepower for application to smaller installations in this field.

Figure 5:
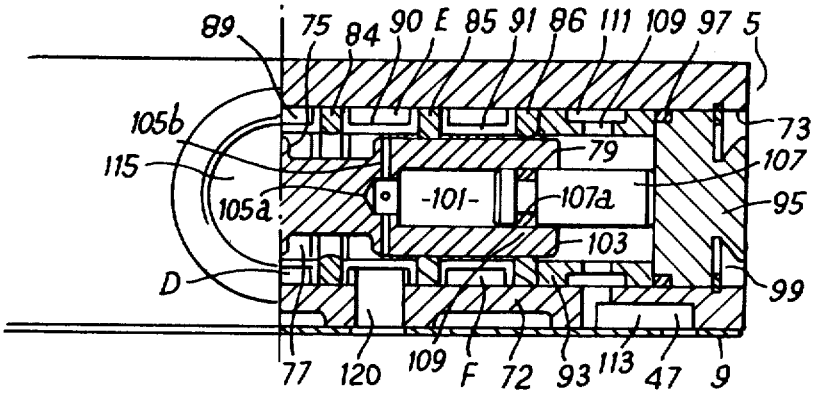
FIG. 5 shows a modification to the spool valve of FIG. I.

FIG. 5 shows a modification of the air valve wherein the passage 105 is replaced by a shorter passage **105*a*, which connects in turn via several small radial passages such as 105*b* to an annular region of the major diameter of the spool closely proximate to the left-hand extremity of spool region 79. A similar arrangement is substituted in place of passage 104 (not shown). Such re-positioning of passage 105 causes the counterbore 101 to be exhausted via port F just prior to the position of symmetry, thus applying earlier additional impulse to the spool movement. It will be understood that the application of sustaining pressure to counterbore 100** will be slightly delayed beyond the position of symmetry when moving to the right.

The action of the spool from right to left is affected in similar fashion, and it has been found that advancing the snap-action in this manner can produce more certain action of the spool under conditions of low applied air pressure. It will be understood that the arrangement of FIG. 5 may also be used with piston valves and slide valves and with valves having formations other than the bias pistons and their associated counterbores as described above.

It has been found that the construction described offers the following advantages:

1. Due to its compact dimensions, the whole power pack assembly may be mounted with the brackets provided on any convenient vertical surface, thus releasing floor space for more effective use.

2. The assembly forms a complete package without the need for 'add on' components.

3. A smooth, ripple-free output is developed, which does not excite resonance in associated machine structures. There are brief discontinuities in the delivery at each end of the piston stroke, but reversal is very rapid, and a small amount of system compliance usually gives adequate bridging. Where perfect smoothness is essential, a very small accumulator will suffice.

4. Liquid under pressure is delivered on system demand, so that flow matching is achieved automatically, but without the continuous noise and heat generation, for example, of a variable delivery rotary pump.

5. A significant economy in first cost can usually be achieved in comparison with a conventional rotary power pack.

6. The device is inherently flameproof because of the total absence of electrics.

7. Lubrication of the air supply is not necessary, because of the choice of sealing materials, and there is therefore no exhaust of oil laden air into the environment.

8. The device will hold pressure over extremely long periods if necessary with miniscule energy consumption and virtually no noise, whilst still making up incidentally losses which occur through valve clearance etc. in the system.

The system of the present invention is generally applicable wherever a compressed air supply is available, and a hydraulic capability of up to about 5 HP in conventional terms is required.

It is particularly attractive in certain specific cases, for instance:

1. Where the hydraulic needs are somewhat incidental, and only one or two small actuators are involved.

2. Where the hydraulic system is installed in a very small and compact area, such that a conventional power pack would be obtrusive. Small power injection moulding machines, hydraulic hose crimping and swaging machines, and small articulated continuous path industrial robots are representative examples.

3. Where the draw-off of hydraulic power is very occasional, or where pressure is to be sustained over long periods.

4. Where the power requirements of the system are quite small. In this connection, it is noted that installed hydraulic horse-powers have diminished in machine tool installations in recent years, partly as a consequence of the development of better electro-mechanical drives for machine movements.

We claim:

1. A fluid operated valve comprising a member slidable in a bore having first and second ends under the action of fluid pressure between a position at said first end in which it connects an inlet port for the fluid with a first outlet port remote from said first end and a position at said second end in which it connects the inlet port with a second outlet port remote from said second end; longitudinal first and second counterbores respectively at the ends of the member remote from said first and second ends and a bias piston slidable in each counterbore to act between a base of that counterbore and the associated end of the bore; first means for applying fluid pressure derived from the first outlet port to the first end of the bore and means for relieving pressure from the second end of the bore and first passage means for simultaneously applying said fluid pressure derived from the first outlet port to the interior of the first counterbore; second means for alternatively applying fluid pressure derived from the second outlet port to the second end of the bore and means for relieving pressure from the first end of the bore and second passage means for simultaneously applying said fluid pressure derived from the second outlet port to the interior of the second counterbore so that when the member is located at the first end of the bore a differential force is applied thereto to move it away from said first end and when the member is located at the second end of the bore a differential force is applied thereto to move it away from said second end; means for relieving pressure from the interior of the first counterbore as the member moves towards the second end and before the inlet port is disconnected from the first outlet port and from the first end of the bore, so that the remainder of the movement of the member towards the second end is rapidly accelerated and is then fully completed by application of said fluid pressure derived from the second outlet port through the second passage means to the second counterbore; and means for relieving pressure from the interior of the second counterbore as the member moves towards the first end and before the inlet port is disconnected from the second outlet port and from the second end of the bore, so that the remainder of the movement of the member towards the first end is rapidly accelerated and is then fully completed by application of said fluid pressure derived from the first outlet port through the first passage means to the first counterbore.

2. A valve according to claim 1 in which the member has a pair of symmetrically disposed first and second circumferential recesses respectively adjacent the first and second counterbores and the bore of the valve is provided with five spaced apart annular ports the central port being the inlet port, the ports immediately on each side of the inlet port being said first and second outlet ports and the outermost ports being first and second exhaust ports respectively remote from said first and second ends, said first and second passage means communicating respectively between the first and second counterbores and the surface of the member adjacent those counterbores the arrangement being such that when the member moves towards the second end and just before a position of symmetry relative to the ports at which position the inlet port is disconnected from both outlet ports, and from the second end of the bore the interior of the first counterbore is connected by the first passage means with the first exhaust port and just beyond said position of symmetry the inlet port is connected to the second outlet port and subsequently the inlet port is connected via the second recess and the second passage means with the second counterbore, and when the member moves towards the first end and just before said position of symmetry at which position the inlet port is disconnected from both outlet ports and from the first end of the bore, the interior of the second counterbore is connected by the second passage means with the second exhaust port and just beyond said position of symmetry the inlet port is connected to the first outlet port and subsequently the inlet port is connected via the first recess and the first passage means with the first counterbore.

3. A fluid operated valve comprising a member slidable in a bore having first and second ends under the action of fluid pressure between a position at said first end in which it connects an inlet port for the fluid with a first outlet port remote from said first end and a position at said second end in which it connects the inlet port with a second outlet port remote from said second end first and second oppositely acting fluid pressure responsive formations on the member, first means for applying fluid pressure derived from the first outlet port to the first end of the bore and means for relieving pressure from the second end of the bore and first passage means for simultaneously applying said fluid pressure derived from the first outlet port to the first formation having a sense of action opposite thereto, second means for alternatively applying fluid pressure derived from the second outlet port to the second end of the bore and means for relieving pressure from the first end of the bore and second passage means for simultaneously applying said fluid pressure derived from the second outlet port to the second formation so that when the member is located at the first end of the bore a differential force is applied thereto to move it away from said first end and when the member is located at the second end of the bore a differential force is applied thereto to move it away from said second end; means for relieving pressure from said first formation as the member moves towards the second end and before the inlet port is disconnected from the first outlet port and from the first end of the bore so that the remainder of the movement of the member towards the second end is rapidly accelerated and then fully completed by application of said fluid pressure derived from the second outlet port and from the second end of the bore to the second formation; and, means for relieving pressure from said second formation as the member moves towards the first end and before the inlet port is disconnected from the second outlet port so that the remainder of the movement of the member towards the first end is rapidly accelerated and then fully completed by application of said fluid pressure derived from the first outlet port to the first formation.

4. A valve according to claim 3 in which the member has a pair of symmetrically disposed first and second circumferential recesses respectively connected with the first and second formations and the bore of the valve is provided with five spaced apart annular ports, the central port being the inlet port, the ports immediately on each side of the inlet port being said first and second outlet ports and the outermost ports being first and second exhaust ports respectively remote from said first and second ends, said first and second passage means and said means for relieving pressure communicating between each respective formation and the bore, so that when the member moves towards the second end just before a position of symmetry relative to the ports at which position the inlet port is disconnected from both outlet ports and from the second end of the bore the first formation is connected with the first exhaust port and just beyond said position of symmetry the inlet port is connected via the second recess to the second outlet port and with the second formation and when the member moves towards the first end just before said position of symmetry at which position the inlet port is disconnected from both outlet ports and from the first end of the bore the second formation is connected with the second exhaust port and just beyond said position of symmetry the inlet port is connected via the first recess to the first outlet port and with the first formation.

5. A motor unit comprising a double acting piston reciprocable in a cylinder under the action of a fluid controlled by a valve which is a fluid operated valve comprising a member slidable in a bore having first and second ends under the action of fluid pressure between a position at said first end in which it connects an inlet port for the fluid with a first outlet port remote from said first end and a position at said second end in which it connects the inlet port with a second outlet port remote from said second end; a first exhaust port disposed between the first outlet port and the second end and a second exhaust port disposed between the second outlet port and the first end; longitudinal first and second counterbores respectively in the ends of the member remote from said first and second ends and a bias piston slidable in each counterbore to act between a base of that counterbore and the associated end of the bore; first and second symmetrically disposed circumferential recesses in fhe member respectively adjacent the first and second counterbores; first means for applying fluid pressure derived from the first outlet port to the first end of the bore and means for relieving pressure from the second end of the bore and first passage means communicating between the first counterbore and the surface of the member adjacent the first recess for simultaneously applying said fluid pressure derived from the first outlet port to the interior of the first counterbore; second means for alternatively applying fluid pressure derived from the second outlet port to the second end of the bore and means for relieving pressure from the first end of the bore and second passage means communicating between the second counterbore and the surface of the member adjacent the second recess for simultaneously spplying said fluid pressure derived from the second outlet port to the interior of the second counterbore so that when the member is located at the first end of the bore a differential force is applied thereto to move it away from said first end and when the member is located at the second end of the bore a differential force is applied thereto to move it away from said second end; the first passage means connecting the interior of the first counterbore with the first exhaust port as the member moves towards the second end and before the inlet port is disconnected from the first outlet port and from the first end of the bore, so that the remainder of the movement of the member towards the second end is rapidly accelerated and is then fully completed by application of said fluid pressure derived from the second outlet port via the second recess through the second passage means to the second counterbore and the second passage means connecting the interior of the second counterbore with the second exhaust port as the member moves towards the first end and before the inlet port is disconnected from the second outlet port and from the second end of the bore, so that the remainder of the movement of the member towards the first end is rapidly accelerated and is then fully completed by application of said fluid pressure derived from the first outlet port via the first recess through the first passage means to the first counterbore; a pair of signal ports opening into the interior of the cylinder and respectively connected with the ends of the bore of the valve, movement of the piston selectively connecting opposite sides thereof through the signal ports with the fluid driving the piston at one end of the bore and with the means for relieving pressure at the other end of the bore so as to produce repeated reciprocation of the valve and the piston.

6. A pneumatic/hydraulic converter comprising a motor unit comprising a double acting piston reciprocable in a cylinder under the action of a fluid controlled by a valve and a hydraulic pump; the valve being a fluid operated valve comprising a member slidable in a bore having first and second ends under the action of fluid pressure between a position at said first end in which it connects an inlet port for the fluid with a first outlet port remote from said first end and a position at said second end in which it connects the inlet port with a second outlet port remote from said second end; a first exhaust port disposed between the first outlet port and the second end and a second exhaust port disposed between the second outlet port and the first end; longitudinal first and second counterbores respectively in the ends of the member remote from said first and second ends and a bias piston slidable in each counterbore to act between a base of that counterbore and the associated end of the bore; first and second symmetrically disposed circumferential recesses in the member respectively adjacent the first and second counterbores; first means for applying fluid pressure derived from the first outlet port to the first end of the bore and means for relieving pressure from the second end of the bore and first passage means communicating between the first counterbore and the surface of the member adjacent the first recess for simultaneously applying said fluid pressure derived from the first outlet port to the interior of the first counterbore; second means for alternatively applying fluid pressure derived from the second outlet port to the second end of the bore and means for relieving pressure from the first end of the bore and second passage means communicating between the second counterbore and the surface of the member adjacent the second recess for simultaneously applying said fluid pressure derived from the second outlet port to the interior of the second counterbore so that when the member is located at the first end of the bore a differential force is applied thereto to move it away from said first end and when the member is located at the second end of the bore a differential force is applied thereto to move it away from said second end; the first passage means connecting the interior of the first counterbore with the first exhaust port as the member moves towards the second end and before the inlet port is disconnected from the first outlet port and from the first end of the bore, so that the remainder of the movement of the member towards the second end is rapidly accelerated and is then fully completed by application of said fluid pressure derived from the second outlet port via the second recess through the second passage means to the second counterbore and the second passage means connecting the interior of the second counterbore with the second exhaust port as the member moves towards the first end and before the inlet port is disconnected from the second outlet port and from the second end of the bore, so that the remainder of the movement of the member towards the first end is rapidly accelerated and is then fully completed by application of said fluid pressure derived from the first outlet port via the first recess through the first passage means to the first counterbore; a pair of signal ports opening into the interior of the cylinder and respectively connected with the ends of the bore of the valve, movement of the piston selectively connecting opposite sides thereof through the signal ports with the fluid driving the piston at one end of the bore and with the means for relieving pressure at the other end of the bore so as to produce repeated reciprocation of the piston, and the hydraulic pump being driven by movement of the piston of the motor unit.

7. A pneumatic/hydraulic converter according to claim 6 in which the valve, the motor and the hydraulic pump are respectively secured one above the other as replaceable modules in a stack each of the modules, being cylindrical and of similar maximum size and shape transverse to the longitudinal axis of the stack.

8. A pneumatic/hydraulic converter according to claim 7 in which a silencer is disposed adjacent the valve and constitutes one of the replaceable modules of the stack.

9. A pneumatic/hydraulic converter according to claim 7 in which a liquid reservoir constitutes one of the replaceable modules of the stack and is disposed adjacent the pump.

* * * * *